US005415745A

United States Patent [19]

Pultan et al.

[11] Patent Number: 5,415,745

[45] Date of Patent: May 16, 1995

[54] METHOD FOR PROVIDING CATHODIC PROTECTION TO UNDERGROUND METALLIC STRUCTURE USING GALVANIC ANODES

[75] Inventors: John M. Pultan, Trafford; Wayne J. May, McDonald; Daniel A. Fanciullacci, Pittsburgh, all of Pa.

[73] Assignee: Corrotech, Inc., Trafford, Pa.

[21] Appl. No.: 710,212

[22] Filed: Jun. 4, 1991

Related U.S. Application Data

[63] Continuation of Ser. No. 462,027, Jan. 8, 1990, abandoned.

[51] Int. Cl.[6] ..... C23F 13/00

[52] U.S. Cl. ..... 204/148; 204/147; 204/197

[58] Field of Search ..... 204/147, 148, 196, 197

[56] References Cited

U.S. PATENT DOCUMENTS

| | | | |
|---|---|---|---|
| 2,157,180 | 5/1939 | Little | 204/197 |
| 2,527,361 | 10/1950 | Hunter | 204/197 |
| 3,186,931 | 6/1965 | Marsh et al. | 204/197 |
| 3,192,144 | 6/1965 | Heuze | 204/435 |
| 3,309,233 | 3/1967 | McPheeters et al. | 204/422 |
| 3,515,654 | 6/1970 | Bordalen et al. | 204/147 |
| 3,725,669 | 4/1973 | Tatum | 307/95 |
| 4,201,637 | 5/1980 | Peterson et al. | 204/148 |
| 4,310,401 | 1/1982 | Stahl | 204/426 |
| 4,318,787 | 3/1982 | Peterson et al. | 204/147 |
| 4,511,444 | 4/1985 | Dukat | 204/148 |
| 4,623,435 | 11/1986 | Nebgen et al. | 204/148 |
| 4,710,644 | 12/1987 | Baach | 204/147 |
| 4,713,159 | 12/1987 | Truitt et al. | 204/197 |
| 4,786,388 | 11/1988 | Tatum, Jr. | 204/197 |

*Primary Examiner*—T. Tung

*Attorney, Agent, or Firm*—David V. Radack; Arnold B. Silverman

[57] ABSTRACT

A method of providing cathodic protection to underground metallic structures which comprises creating an excavation spaced from the underground metallic structure and placing in the excavation a hollow casing having a perforate section, the hollow casing being adapted to hold therein a galvanic anode. The method further comprises establishing an electrical connection between the galvanic anode and the underground metallic structure, placing the galvanic anode in the hollow casing and then filling the excavation and the hollow casing with a filler material. The apparatus of the invention comprises a hollow rigid casing adapted to contain at least one galvanic anode, the casing having a perforate section such that electric current from the galvanic anode can flow out of the casing towards the underground metallic structure. A related method of replacing galvanic anodes is also provided.

13 Claims, 2 Drawing Sheets

METHOD FOR PROVIDING CATHODIC PROTECTION TO UNDERGROUND METALLIC STRUCTURE USING GALVANIC ANODES

This is a continuation of application Ser. No. 07/462,027, filed Jan. 8, 1990, now abandoned.

BACKGROUND OF THE INVENTION

1. Field of the Invention

This invention relates to a method and apparatus for providing cathodic protection to underground metallic structures using galvanic anodes, and more particularly relates to a casing for holding the galvanic anodes, a method of placing the casing near the underground metallic structure and replacing galvanic anodes.

2. Background Information

Cathodic protection of underground metallic structures is a method of preventing corrosion. Corrosion is a natural process that occurs when a refined metal wants to revert to the ore from which it was derived. For example, iron is not found in its refined state in nature. Therefore, an underground iron or steel pipe is essentially in an unstable state and can be expected to eventually revert to iron ore (corroding).

It is known that corrosion occurs where electric current flows away from the underground metallic structure into the electrolyte. This area is called the anodic area. Conversely, corrosion does not occur at the areas where electric current flows from the electrolyte onto the metallic structure. This is called the cathodic area. Cathodic protection involves providing current to the metallic structure with sufficient magnitude to polarize all the cathodic areas up to the open circuit potential of the anodic areas.

There are various methods of applying cathodic protection. One method is by using an impressed current system. This involves placing an anode in the electrolyte and connecting its positive terminal to a DC power source. The structure to be protected is then connected to the negative terminal of the power source. Because the power source is almost always a rectifier unit, this system is sometimes referred to as a rectifier type system.

An example of an impressed current system is U.S. Pat. No 3,725,669. The apparatus consists of a plastic casing having an upper imperforate section and a lower pipe section with a plurality of openings. The bottom of the plastic casing has a check valve. After lowering the pipe into the bore hole, a wash pipe is threadedly connected to the check valve so that the wash pipe extends through the casing. The end of the hose is connected to a source of clean water which pumps clean water into the hole. This water is pumped in until all of the mud has been cleared from the casing. The hose is then disconnected from the water supply and connected to a hopper containing a carbonaceous slurry material. This carbonaceous slurry is introduced into the area between the bore hole and casing. After this, a plurality of anodes (mounted on a support line) are lowered into the casing. The anodes are connected by electrical conduits to a rectifier unit. When the anodes need to be replaced, the rectifier unit is disconnected, the cap is removed and a hose carrying water (FIGS. 8 and 9) is placed into the casing to fluidize the carbonaceous material. After the carbonaceous material has been fluidized, the anodes are removed, and fresh anodes are placed inside the casing.

The impressed current system, however, is not practical for cathodically protecting underground metallic structures located in the vicinity of other infrastructures. This is because the impressed current system creates electrical interference and can cause detrimental corrosion effects on other metallic underground structures, such as water supply mains, underground electrical and telephone cables and manholes that are in the vicinity of impressed current systems. Thus, impressed current systems are generally found in rural areas where interference is less of a problem.

Additional problems with impressed current systems include the higher cost and extensive installation and maintenance required for these systems. Impressed current systems require electric meters, rectifier cover enclosures, ampere monitoring gauges, electrical breaker switches and lightning arrestors. These components add to the cost of producing, installing and maintaining these systems. Finally, the large rectifier units, being placed above the ground, would further congest already crowded urban pedestrian sidewalks and are unsightly.

Another method of cathodic protection involves using a galvanic anode. In this system, anodes made of materials such as magnesium and zinc are buried in the ground near the metallic structure to be protected. The anodes are then connected to a metallic structure to be protected. Because of the potential differences between the anode and the metallic structure to be protected, current flows from the galvanic anode to the metallic structure to be protected. See U.S. Pat. Nos. 2,527,361; 4,511,444; and 4,623,435.

In order to install a galvanic anode near an underground metallic structure, an area near the structure must be excavated and the galvanic anode buried in the soil. This method is costly and time consuming, especially if installation is to be done in urban areas, extensively paved areas and areas that may accommodate other underground utilities.

The cur cent flow from the galvanic anode provides protective current to the structure until the anode material has been consumed to the point that the amount of current supplied is no longer of practical value. Once consumed, installation of a new anode is required. Because of this, the remains of the spent galvanic anodes must be extracted from the ground and new galvanic anodes put in their place. This involves re-excavating the area where the exhausted anode is placed and placing a new anode in its place and refilling the excavation site. See U.S. Pat. No. 3,186,931. In certain areas, this process often involves tearing up pavement and subsequently restoring the excavation site. Permits and other government approvals must be obtained to perform this work. As will be appreciated, this is a labor intensive task that not only is expensive, but also causes disruption and inconvenience in the excavation area.

Despite the known apparatus and methods, there still remains a need for an apparatus and method of providing cathodic protection to underground metallic structures using galvanic anodes that is simple and effective and requires less time and disruption.

SUMMARY OF THE INVENTION

The invention has satisfied the above need. The method of providing cathodic protection to underground metallic structures comprises creating an excavation spaced from the underground metallic structure and placing in the excavation a hollow casing having a perforate section, the hollow casing being adapted to hold therein at least one galvanic anode. The method further comprises establishing an electrical connection between the galvanic anode and the underground metallic structure to be protected, placing the galvanic anode in the hollow casing and then filling the excavation and the hollow casing with a filler material.

The apparatus of the invention comprises a hollow casing adapted to contain the galvanic anodes, the hollow casing having a perforate section such that electric current from the galvanic anode can flow out of the hollow casing towards the underground metallic structure.

A method of replacing a galvanic anode is also provided. The galvanic anode is electrically connected to an underground metallic structure through a terminal board. The galvanic anode, along with a filler material, is disposed in a hollow casing which has a perforate section and which is capped by a cap means on its upper portion. The method comprises removing the cap means, electrically disconnecting the galvanic anode from the terminal board and employing a vacuum extraction means to vacuum extract the galvanic anode and the filler material from the interior of the casing. The method further comprises placing in the hollow casing a second galvanic anode which has attached thereto a conductor, filling the hollow casing with a filler material, and establishing an electrical connection between the galvanic anode and the underground metallic structure by means of connecting the conductor to the terminal board, and recapping the hollow casing with cap means.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
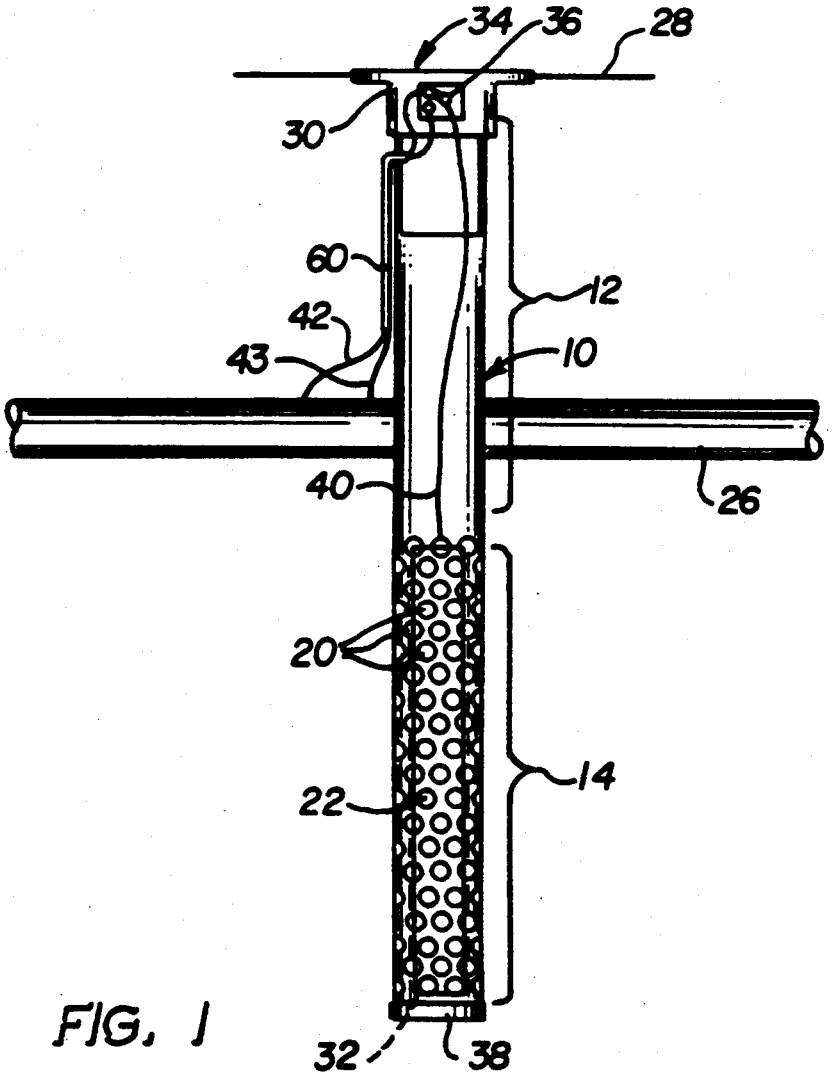
FIG. 1 is a front elevational view, partially in section, showing the casing of the invention holding a galvanic anode which is connected through the terminal board to a main line pipe.

Referring to FIG. 1, the apparatus of the invention is shown. The apparatus consists of a hollow casing 10 having an upper imperforate section 12 and a lower perforate section 14. The casing 10 is preferably made of ABS plastic (minimum code schedule 20), but can also be made of materials of such as for example, fiberglass. Chloride type composition pipes, such as PVC plastic, however should not be used because of the possibility that small amounts of chloride gas, created when a galvanic anode is working, may react with the PVC causing the casing to soften. The hollow casing is preferably six inches in diameter and about ten to twelve feet long, although it will be appreciated that different lengths and diameters of hollow casing can be used if desired. Also, if desired, the casing length can be varied by cutting the casing or by adding any desired length of casing.

The lower perforate section 14 contains a plurality of openings 20 which are preferably circular having a diameter of about 13/16 inches. A galvanic anode 22 is disposed inside the casing 10 so that, preferably, the entire length of the anode is surrounded by the lower perforate section 14. The galvanic anode 22 can be made from materials selected from the group consisting of magnesium, zinc, aluminum, steel, lead, sodium, chromium, iron, nickel, tin, cadmium and cobalt.

The hollow casing 10 is placed in a small hole excavation (not shown) which is spaced from an underground metallic structure, such as, for example, main line pipe 26 conveying natural gas. The hollow casing 10 is preferably buried entirely beneath the ground level 28, such that only the first cap means 34 (discussed below) is visible on the ground 28. It will be appreciated that the invention can be used in connection with other underground metallic structures such as storage tanks, pilings, buried cables, underground electrical systems, electrical generating stations, storage tank piping, water supply lines, cast iron sewage lines and petroleum product lines.

The hollow casing 10 has an upper open end 30 and lower open end 32. The upper open end 30 is capped by a first cap means 34 which has disposed thereon a terminal board 36. The lower open end 32 is capped by a second cap means 38. The first cap means 34 is placed so that it surrounds the outer circumference of the pipe at the open end 30 of the casing 10.

The terminal board 36 is adapted to receive conductors 40 and 42, 43 from the galvanic anode 22 and the main line pipe 26, respectively. As can best be seen in FIG. 2, the galvanic anode conductor 40 is connected to the anode connector pin 50 on the terminal board 36. The anode connector pin 50 is connected by means of a shunt connector 51 to the metallic structure conductor wire connector pin 52 of the terminal board. One of the conductors 42 leading to the main line pipe 26 is connected to the metallic structure conductor wire connector pin 52 and the second conductor wire 43 leading to the main line pipe 26 is connected to the other metallic structure conductor wire connector pin 53 of the terminal board 36. In practice, the conductors 42 and 43 are usually red in color and the pins 52 and 53 are either colored red or labelled with an "R" (reference numbers 62 and 63, respectively). The anode connector 50 is labelled with an "A", reference number 60. The terminal board 36 itself can be made of a hard clear plastic such as Lexan, a trademark of the DuPont Company, and can contain indicia 70 which indicates such information as the anode type, position and weight and other useful information.

Referring again to FIG. 1, it will be seen that the main line pipe conductors 42 and 43 are preferably threaded through a plastic test lead conduit 60 to be attached to the main line pipe 26. The conductors 42 and 43 are preferably attached to the main line pipe 26 a minimum of twelve inches apart to avoid excessive stress corrosion points on the pipe at the attachment points which are conveyed through the conductors 42 and 43 to the terminal board 36. Conductors 42 and 43 are connected to the pipe before the casing is placed in the excavation and are attached to the pipe by a thermite weld. As is known, thermite welds are made by filling a graphite mold which houses the conductor and a weld metal such as copper oxide and aluminum. The powder is ignited by using a flint gun and the reaction which results produces molten copper which flows into the weld cavity and welds the conductor to the pipe.

Figure 2:
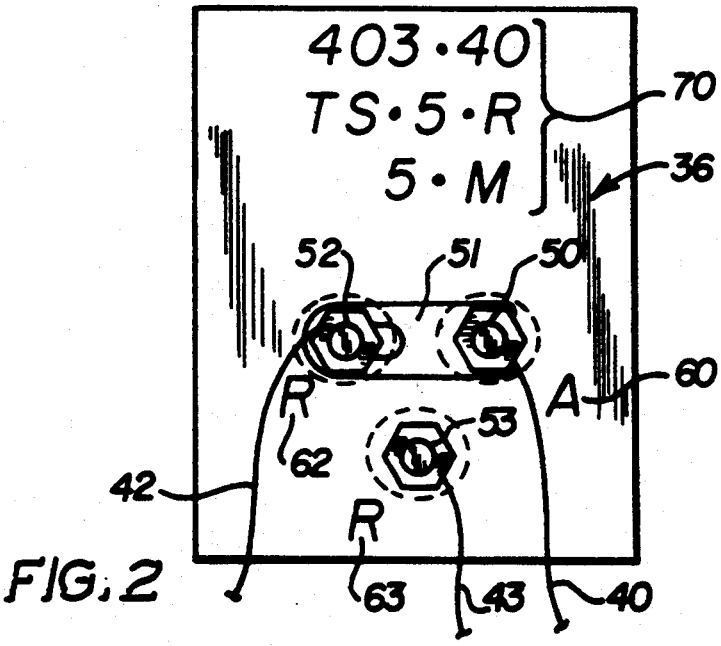
FIG. 2 is an enlarged detailed view of the terminal board shown in FIG. 1.
Figure 3:
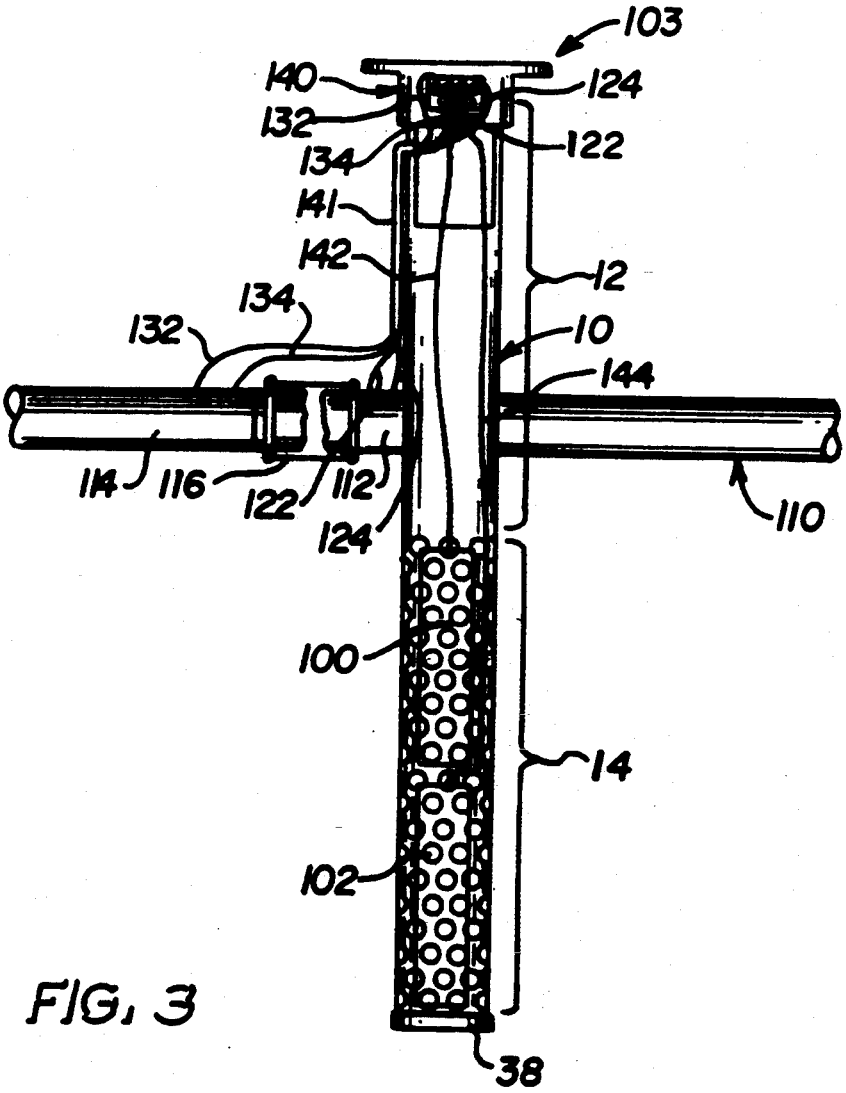
FIG. 3 is a front elevational view, partially in section, showing the casing of the invention holding a pair of galvanic anodes which are both connected through the terminal board to a main line pipe.
Figure 4:
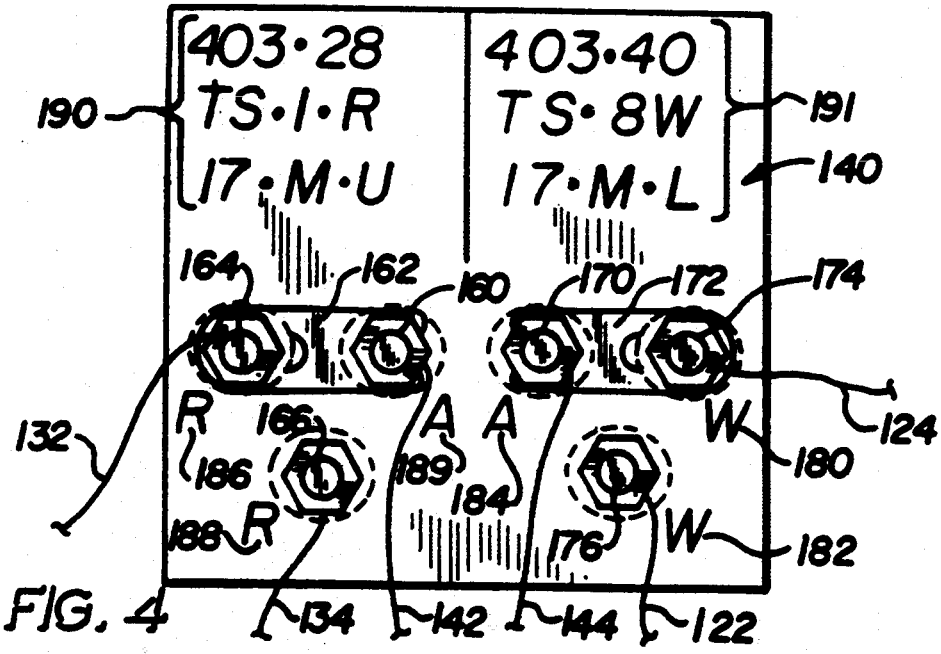
FIG. 4 is an enlarged detailed view of the terminal board shown in FIG. 3.

Referring now to FIGS. 3 and 4, where like parts to those of FIGS. 1 and 2 are identified by like reference characters, the invention is shown used in association with a pair of anodes, an upper anode 100 and a lower anode 102, disposed in the perforate section 14 of the casing 10. A cap means 103, similar to that of cap means 34, is placed on the upper portion of the pipe. The main line pipe 110 has two sections 112 and 114 which are joined by an insulated coupling 116.

Often times, one of the two sections 112 and 114 is an older structure than the other section. For example, if a section of main line pipe is leaking and needs to be replaced, the new section must be insulated with couplings, such as coupling 116, because the new structure will be anodic to the older structure if not physically separated. Therefore, using casing 10 with an upper anode 100 and a lower anode 102 can provide cathodic protection on two different sections 112 and 114 of main line pipe.

As was described in FIGS. 1 and 2, there are two conductors from each section 112 and 114 of the main line pipe 110. Conductors 122 and 124 are connected to section 112 as by a thermite weld and conductors 132 and 134 are connected to section 114 as by a thermite weld. These conductors are threaded through plastic test lead conduit 141 to be connected to a six-pin terminal board 140. There are also provided conductors 142 and 144 leading from the terminal board 140 to each respective anode 100 and 102.

The terminal board 140 is shown in FIG. 4. Upper anode 100 is connected by conductor 142 to anode connector pin 160 on terminal board 140. Anode connector pin 160 is connected by means of a shunt connector 162 to conductor wire connector pin 164. Attached to the conductor wire connector pin 164 is conductor wire 132 which in turn is connected to section 114 of the main pipe line 110 by a thermite weld. Conductor wire 134 is connected to conductor wire connector pin 166. Conductor wire 132 is also connected to section 114 of the main pipe line by a thermite weld.

Conductor 144 from lower anode 102 is connected to anode connector pin 170 on terminal board 140. Anode connector pin 170 is connected by means of a shunt connector 172 to conductor wire connector pin 174. Attached to the conductor wire connector pin 174 is conductor wire 124 which in turn is connected to section 112 of the main pipe line by a the finite weld. Conductor wire 122 is connected to conductor wire connector pin 176. Conductor wire 122 is also connected to section 112 of the main pipe line by a thermite weld.

As with terminal board 36 and the associated conductors described in FIGS. 1 and 2, the terminal board 140 is made of Lexan, a trademark of DuPont Company, and the conductors are color coded. For example, conductors 122 and 124 can be white in color and the conductor connector pins 174 and 176 labelled with a "W", (reference numbers 180 and 182). The anode connector pin 170 can be labelled with an "A" (reference number 184). Conductors 132 and 134 can be red in color and the conductor connector pins 164 and 166 can be labelled with an "R" (reference numbers 186 and 188). The anode connector 160 can be labelled with an "A" (reference number 189). The terminal board 140 can contain two separate sections of indicia 190 and 191 where information concerning the installation, such as anode type, weight and position, can be indicated.

The method of installing the hollow casing 10 comprises first creating an excavation spaced from the underground metallic structure desired to be cathodically protected. The excavation is preferably created by employing a vacuum extraction means, such as a vacuum extractor made by BBI, Model No. C-320, which may be advantageously mounted on a truck. The vacuum extractor means includes a hose leading from the vacuum extractor which conveys the extracted earth from the excavation to the vacuum extractor. The conductors 42 and 43 are then connected to the pipe by means of a thermite weld, as was explained above.

After a desired depth excavation is created and the conductors 42 and 43 are connected to the pipe, the casing 10 is placed therein. It is preferred that the perforate section 14 containing the galvanic anode(s) be placed at least two feet below the depth of the main line pipe. This will allow a sufficient spread of returning current flow from the anode to the pipe line. The perforate section 14 of the casing 10 is preferably wrapped with a biodegradable cloth covering to resist entry of foreign particles into the casing 10 after it is placed into the excavation.

Another but less preferred approach for resisting entry of foreign particles into the casing 10 after it is placed into the excavation is to use air pressure to force out foreign objects from inside the casing through the holes in the perforate section 14. This air pressure can be provided by reversing the vacuum extraction means to blow out air. The hose of the vacuum extracting means is placed into the casing and the air pressure blows out foreign particles through the holes 20 in the perforated section 14. This method is less preferred because it might cause voids in the soil, thus causing inadequate contact between the electrolyte and the anode.

The galvanic anode is then lowered into the casing 10 and is held in place while a prepared chemical backfill is filled in the casing 10 and in the annulus between the casing 10 and excavation. A preferred chemical backfill can consist of 75% by weight gypsum, 20% by weight bentonite clay and 5% by weight sodium sulfate. It will be appreciated that other mixtures of the same or different or additional materials can be used depending on such factors as the soil resistivity, for example.

Another, less preferred, method involves placing the anode in the casing before the casing is placed into the excavation, however this would be a much more difficult and cumbersome operation.

The conductor 40 of galvanic anode 22 is then connected to the terminal board 36 as was shown in FIG. 2. Conductors 42, 43 are also attached to the terminal board 36 and then are attached to the main line pipe. After this the casing is capped by the cap means 34.

The galvanic anode system of providing cathodic protection to underground metallic structure of the invention works by current flowing from the galvanic anode to the underground metallic structure through the openings of the perforated sections. As is known, the difference in potential between the galvanic anode and the underground metallic structure causes the current to flow away from the galvanic anode into the electrolyte (soil) to cathodically protect the underground metallic structure.

During this process, the galvanic anode will gradually exhaust itself and need to be replaced. The method of the invention also includes a method of replacing a galvanic anode which is electrically connected to an underground metallic structure through a terminal board disposed on said casing, the galvanic anode and a filler material being disposed in a hollow casing which has a perforate section and which is capped by a cap means on its upper portion, the casing being placed in an excavation spaced from said underground metallic structure. The method comprises removing the cap means, electrically disconnecting the galvanic anode from the terminal board and employing a vacuum extraction means to vacuum extract the galvanic anode and the filler material from the interior of the casing. The method further comprises placing in the casing a second galvanic anode, filling the casing with a filler material, establishing an electrical connection between the galvanic anode and the underground metallic structure by means of connecting the conductor to the terminal board, and recapping the casing with first cap means.

The vacuum extraction means can also be used to insure good soil to filler material continuity. This is accomplished by pressurizing the filler material once it is placed in the casing.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. A method of providing cathodic protection to an underground metallic structure comprising:

creating an excavation spaced from said underground metallic structure;

placing in said excavation a hollow casing having a perforate section, said hollow casing adapted to hold therein at least one galvanic anode;

establishing an electrical connection between said galvanic anode and said underground metallic structure;

placing said galvanic anode into said hollow casing;

filling said excavation and said casing with a filler material; and employing vacuum extraction means to create said excavation.

2. The method of claim 1, wherein establishing said electrical connection between said galvanic anode and said underground metallic structure by providing a terminal board and at least two conductors;

connecting a first conductor between said galvanic anode and said terminal board; and connecting a second conductor between said terminal board and said underground metallic structure.

3. The method of claim 2, including capping the upper portion of said hollow casing with first cap means, said first cap means having disposed thereon said terminal board.

4. The method of claim 3, including before placing said hollow casing into said excavation, wrapping said perforate section with a cotton wrap to resist entry of undesired foreign objects into said hollow casing once said casing is placed into said bore hole.

5. The method of claim 3, wherein employing as said vacuum extraction means a vacuum extraction system mounted on a vehicle.

6. The method of claim 5, including after said hollow casing is placed in said excavation, introducing into said hollow casing air pressure to force out undesired foreign objects from the interior of said hollow casing through said perforate section of said hollow casing.

7. The method of claim 6, wherein said air pressure is provided by said vacuum extraction means.

8. The method of claim 3, wherein filling said bore hole and said hollow casing with filler materials selected from the group consisting or gypsum, bentonite clay, sodium sulfate and mixtures thereof.

9. The method of claim 1, including providing a first galvanic anode and a second galvanic anode and establishing an electrical connection between said first galvanic anode and a first portion of said underground metallic structure and said second galvanic anode and a second portion of said underground metallic structure.

10. A method of replacing a first galvanic anode which is electrically connected to an underground metallic structure through a terminal board, said galvanic anode and a filler material being disposed in a hollow casing which has a perforate section and which is capped by a cap means on its upper portion, said hollow casing being placed in an excavation spaced from said underground metallic structure, the method comprising:

removing said cap means;

electrically disconnecting said first galvanic anode from said terminal board;

employing a vacuum extraction means to vacuum extract said galvanic anode and said filler material from the interior of said hollow casing;

placing in said hollow casing a second galvanic anode which has attached thereto a conductor;

filling said hollow casing with a filler material;

establishing an electrical connection between said second galvanic anode and said underground metallic structure by means of connecting said conductor to said terminal board; and recapping said hollow casing with said cap means.

11. The method of claim 10, wherein employing said vacuum extraction means to apply pressure on said filler material so that said filler material establishes contact with the electrolyte surrounding said excavation.

12. The method of claim 11, wherein employing as said filler material a material selected from the group consisting of gypsum, bentonite clay, sodium sulfate and mixtures thereof.

13. The method of claim 12, wherein replacing said first galvanic anode with at least two galvanic anodes, said galvanic anodes being electrically connected to separate portions of said underground metallic structure.

* * * * *

UNITED STATES PATENT AND TRADEMARK OFFICE

CERTIFICATE OF CORRECTION

PATENT NO. : 5,415,745

DATED : May 16, 1995

INVENTOR(S) : John M. Pultan et al.

It is certified that error appears in the above-identified patent and that said Letters Patent is hereby corrected as shown below:

Column 5, line 50, "the finite" should be --thermite--.

Signed and Sealed this

Third Day of September, 1996

*Attest:*

Bruce Lehman

BRUCE LEHMAN

*Attesting Officer*

*Commissioner of Patents and Trademarks*